US005915693A

United States Patent [19]

Piotrowski et al.

[11] Patent Number: 5,915,693

[45] Date of Patent: Jun. 29, 1999

[54] JUMP ROPE PLAY FEATURE FOR A PINBALL GAME

[76] Inventors: Peter J. Piotrowski, 3401 N. California; Brad D. Cornell, 3401 N. California Ave.; Dwight Sullivan, 3401 N. California, all of Chicago, Ill. 60618

[21] Appl. No.: 09/017,190

[22] Filed: Feb. 2, 1998

[51] Int. Cl.[6] ..... A63F 7/30

[52] U.S. Cl. ..... 273/129 S; 273/121 A

[58] Field of Search ..... 273/118, 119, 273/121, 123, 129 R, 129 S, 129 T, 127 R, 127 B, 127 D

[56] References Cited

U.S. PATENT DOCUMENTS 4,373,725 2/1983 Ritchie .
5,351,954 10/1994 Oursler et al. .
5,358,242 10/1994 Trudeau et al. .
5,358,243 10/1994 Eddy et al. .
5,368,299 11/1994 Driska ..... 273/119 A X
5,415,403 5/1995 Ritchie et al. .
5,516,103 5/1996 Lawlor et al. .
5,524,887 6/1996 Trudeau et al. .
5,806,851 9/1998 Gomez et al. ..... 273/121 A

*Primary Examiner*—Raleigh W. Chiu

[57] ABSTRACT

A game ball cradle is positioned upon the playfield of a pinball game. A player-controlled solenoid plunger mechanism "pops" a ball positioned within the cradle into the air. A wire form jump rope is rotatably connected to an electric motor. The jump rope is positioned so that when it is rotated, it will pass under a game ball that has been properly "popped" by the player. A switch indicates to the game microprocessor that the jump rope has completed a revolution. Optical detectors indicate to the game microprocessor that the game ball is within the cradle so that the electric motor may be activated and, upon completion of a successful "jump", the player's score incremented and the speed of the jump rope rotation increased.

18 Claims, 4 Drawing Sheets

JUMP ROPE PLAY FEATURE FOR A PINBALL GAME

BACKGROUND

The invention relates generally to amusement devices in the form of rolling ball or pinball games and, more particularly, to play features for such games.

Pinball games typically feature an inclined playfield with a number of play features, such as ramps, targets, bumpers and the like, mounted and arranged thereon. A player operates flippers mounted on the playfield to direct game balls at the play features in an attempt to score points and control the play of the game.

The player interest and appeal generated by a pinball game largely depends upon the novelty and challenge presented by its play features. Play features having entertaining visual effects also provide a pinball game with increased player interest and appeal. Accordingly, there is a constant demand for pinball game manufacturers to design novel, challenging and visually entertaining play features.

One popular play feature is the ball popper. Ball poppers typically include a recess for trapping the game ball on or below the playfield for a period of time until an ejection device projects the ball back into play. Ejection of the ball from the recess is usually accomplished by a solenoid plunger mechanism. The solenoid plunger is typically activated by the pinball game microprocessor after a period of time has transpired or when the player has achieved a predetermined score or struck a certain target. Ball detection switches placed near or within the recess signal the microprocessor that a ball is within the recess.

Most prior art ball poppers have been used solely to return game balls to the playfield. The present invention discloses a novel use of a ball popper. In addition, player control of most prior art ball poppers has been very limited. A ball popper that could be controlled by the player would offer the player an additional challenge above and beyond merely directing the game ball with the game flippers.

It is known in the art that a pinball may be controlled by an electromagnet positioned upon or under a playfield. For example, U.S. Pat. No. 5,415,403 to Ritchie et al. discloses a ball well with an electromagnetic coil surrounding its entrance. A playfield-mounted ball sensor detects when a game ball is near the well entrance and briefly energizes the electromagnetic coil. As a result, the ball is pulled towards the well entrance, and the momentum created thereby causes the ball to travel into the well where it is retained. When specific game conditions are met, the ball is ejected back onto the playfield. This is accomplished by once again briefly energizing the electromagnet to pull the ball towards the well entrance so that it is propelled out of the well.

As another example, U.S. Pat. No. 4,373,725 to Ritchie discloses an electromagnet positioned under a playfield near an entry port to an exit lane and a means manually operable by a player for energizing the electromagnet. The orientation of the electromagnet is such that when it is energized, the game ball is pulled away from the exit lane entry port so that it remains in play.

While both of the above patents use electromagnets to control the position of a game ball upon the playfield, neither discloses the combination of an electromagnet with a plunger-activated ball popper. More specifically, neither patent discloses the use of an electromagnet to keep a game ball properly positioned within or upon a ball popper after the ball has been "popped." Furthermore, U.S. Pat. No. 5,415,303 uses an electromagnet, as opposed to a plunger, as a means of ejecting a game ball onto the playfield.

Accordingly, it is an object of the present invention to provide a play feature that utilizes a ball popper in a novel manner.

It is another object of the present invention to provide a play feature that utilizes a player-controlled ball popper to challenge a player's skill.

It is still another object of the present invention to provide a play feature that combines a ball popper with an electromagnet so that the game ball may be controlled as it is "popped."

SUMMARY

The present invention is directed to a "jump rope" play feature for a pinball game. The play feature includes a cradle positioned relative to the playfield so that it may receive and hold a game ball that has been directed thereto. A solenoid plunger mechanism is positioned under the cradle so that when it is activated by the player, via the game player switches, the game ball is "popped" or propelled into the air. An electric motor is connected to a wire form in the approximate shape of a jump rope so that when it is energized, the jump rope rotates so as to pass under the game ball when it has been properly popped into the air. An electromagnet is positioned beneath the cradle and is briefly activated after the solenoid plunger mechanism "fires." As a result of the magnetic force, the game ball remains centered over the cradle while it is airborne.

A pair of optical detectors indicate when a game ball is within the cradle of the play feature. In turn, a microprocessor energizes the electric motor which rotates the jump rope and thus operation of the play feature begins. A switch indicates to the microprocessor when the jump rope has completed a rotation. At that time, the microprocessor utilizes the optical detectors to determnine if the game ball is back in the cradle. If so, the speed ofjump rope rotation may be increased and the player's score is incremented. Play then continues. If the game ball is not within the cradle, indicating a miss, the microprocessor stops the rotation of the jump rope.

For a more complete understanding of the nature and scope of the invention, reference may now be had to the following detailed description of embodiments thereof taken in conjunction with the appended claims and accompanying drawings.

DESCRIPTION

Figure 1:
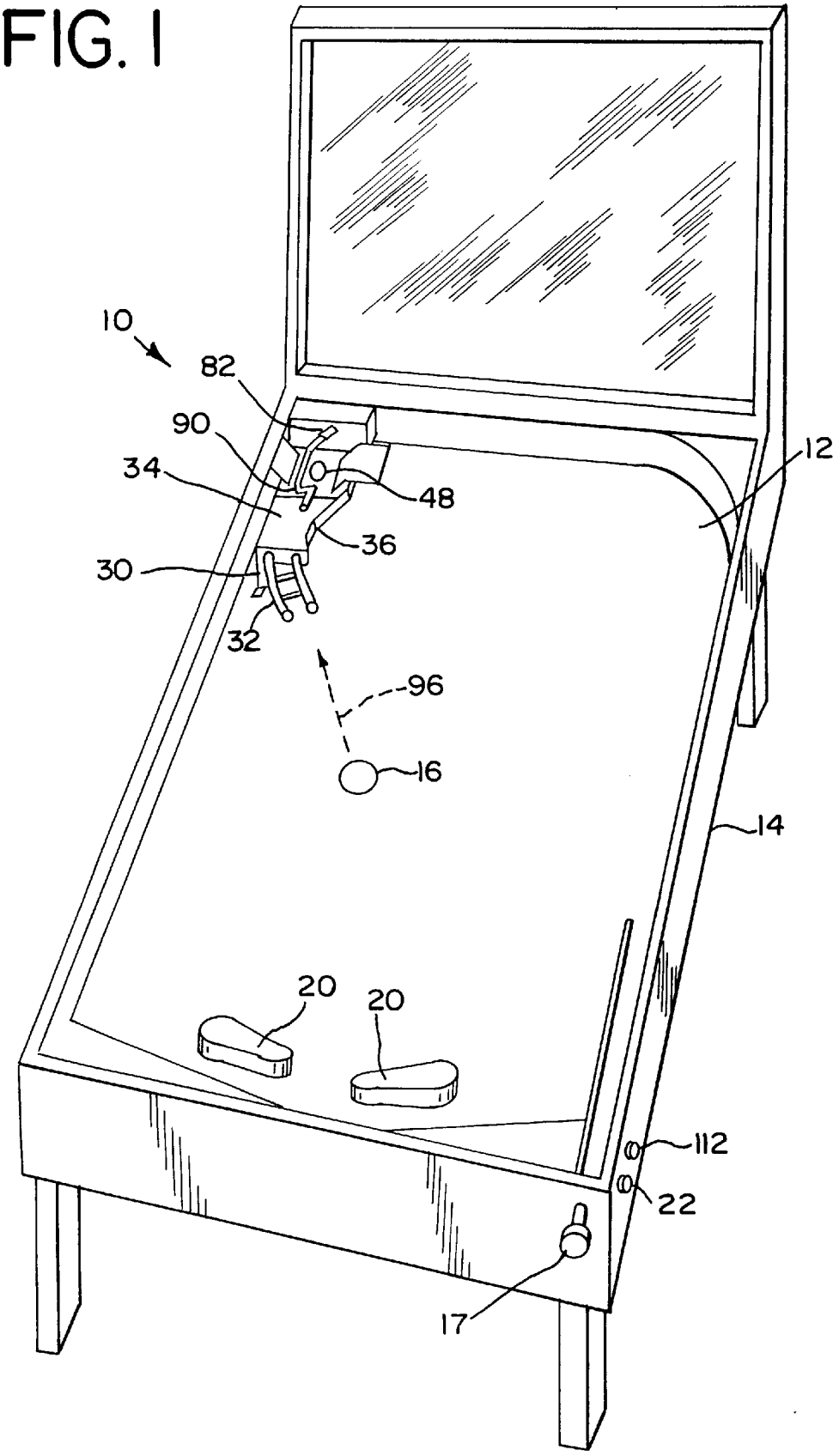
FIG. 1 is a perspective view of a pinball game incorporating an embodiment of the play feature of the present invention.

Referring to FIG. 1, an embodiment of the jump rope play feature of the invention, indicated generally at 10, is shown positioned upon the inclined playfield 12 of a pinball game 14. As is known in the art, game ball 16 is introduced onto playfield 12 via a shooter 17 or similar means. Once on playfield 12, game ball 16 rolls under the force of gravity towards flippers 20. A player manipulates flippers 20 via player switches 22 so that the ball 16 is propelled up playfield 12 where it may contact various play features.

Figure 2:
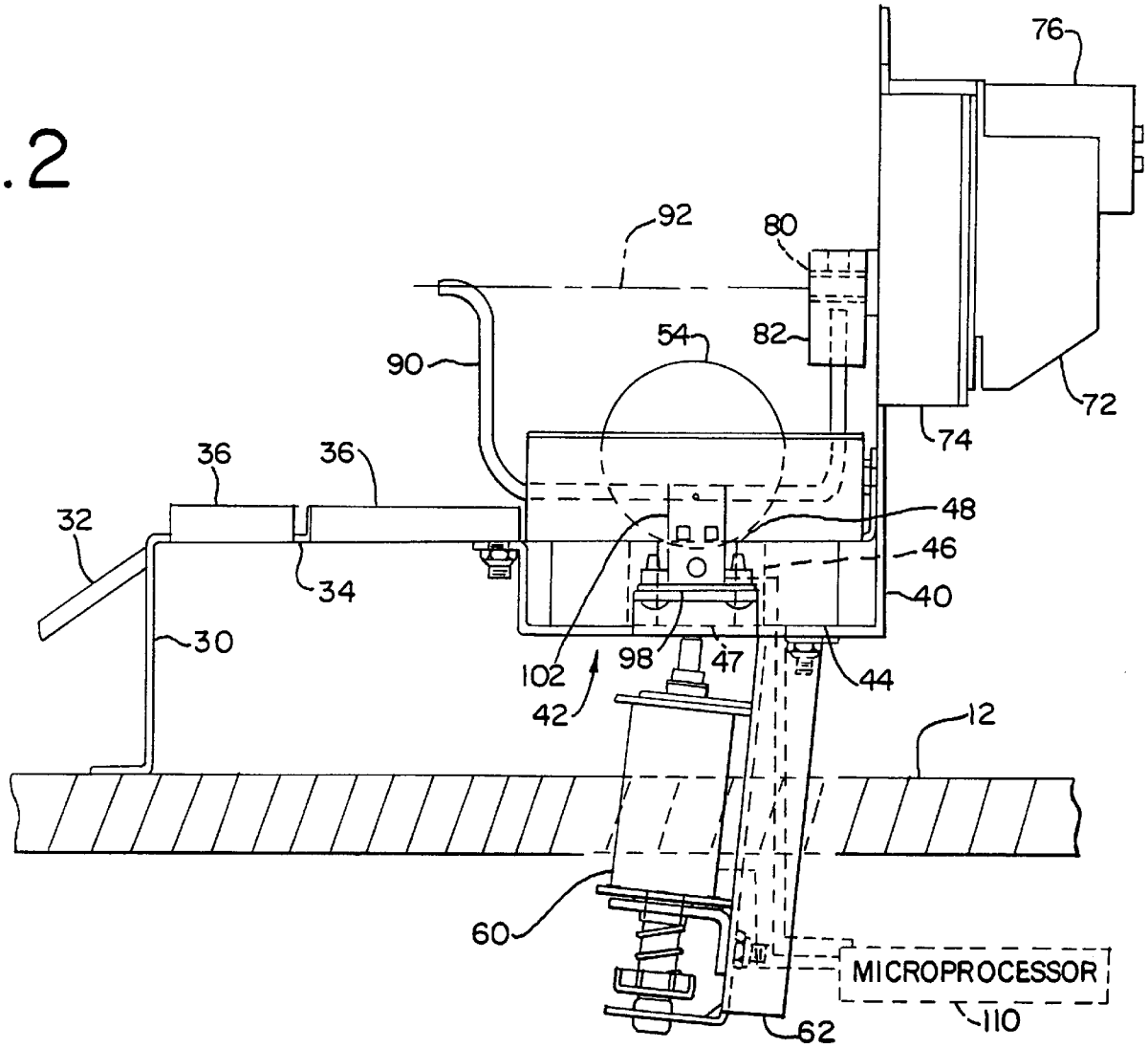
FIG. 2 is a partial sectional side view of the play feature of FIG. 1.

As may be seen from FIG. 1, jump rope play feature 10 is mounted to the wall bordering the back edge of playfield 12, and to playfield 12 by tab 30, so that it is in an elevated position. As shown in FIGS. 1 and 2, a wire form ramp 32 is attached between an elevated platform 34 and playfield 12. The platform 34 features guard rails 36 that prevent a game ball from falling back to playfield 12.

Figure 3:
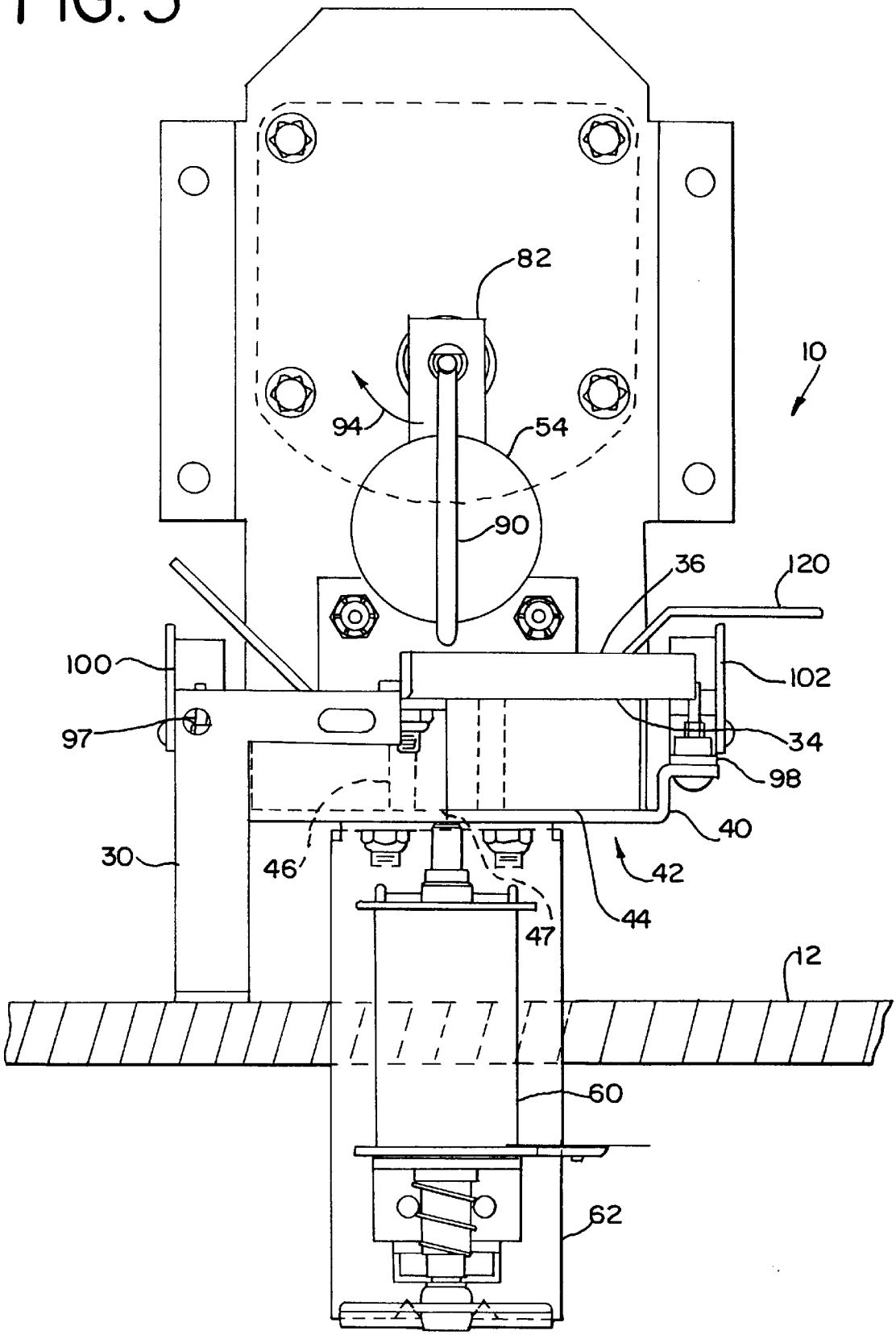
FIG. 3 is a partial sectional front view of the play feature of FIG. 1.

As shown in FIGS. 2 and 3, platform 34 is attached to a base 40. An electromagnet 42 is mounted within base 40 and includes a cylindrical spool 44 having a core 46 upon which a wire is wound to form an electromagnet. A central opening 47 is formed through the center of core 46 and defines at its upper end a cradle 48 that is sized so as to support a game ball 54, as illustrated in FIG. 2.

A solenoid plunger mechanism 60 is mounted to the bottom of base 40 by bracket 62. Such mechanisms are well known in the art and their operation and construction will be readily apparent to those of ordinary skill. Solenoid plunger mechanism 60 is thus positioned so that when it is "fired", its plunger passes through central opening 47 to project the ball into the air a short distance, as illustrated in FIG. 3.

Referring to FIG. 2, mounted to the back of base 40 is electric motor 72, gearbox 74 and switch 76. Attached to the output shaft 80 of gearbox 74, by way of connector 82, is a wire form "jump rope" 90. Jump rope 90 is substantially rigid and rotates about axis 92, for example, in a direction indicated by arrow 94 (FIG. 3), when electric motor 72 is energized.

Referring to FIG. 1, game ball 16 accesses jump rope play feature 10 via wire ramp 32 when the player directs game ball 16 up the ramp, as illustrated by dashed arrow 96. Once game ball 16 travels up ramp 32, it travels across platform 34 and comes to rest in cradle 48, as shown in FIG. 2. While this occurs, jump rope 90 is in its initial position, illustrated in FIG. 1, whereby it does not interfere with a game ball accessing cradle 48.

As shown in FIGS. 2 and 3, mounted on the sides of base 40 via brackets 97 and 98 are optical detectors 100 and 102. The optical detectors 100 and 102 are positioned directly across from one another so that the light beam passing between them passes over cradle 48. As a result, when ball 54 is resting in cradle 48, the light beam is interrupted and optical detectors 100 and 102 signal a game computer, such as microprocessor 110 in FIG. 2, to start the play feature.

Figure 4:
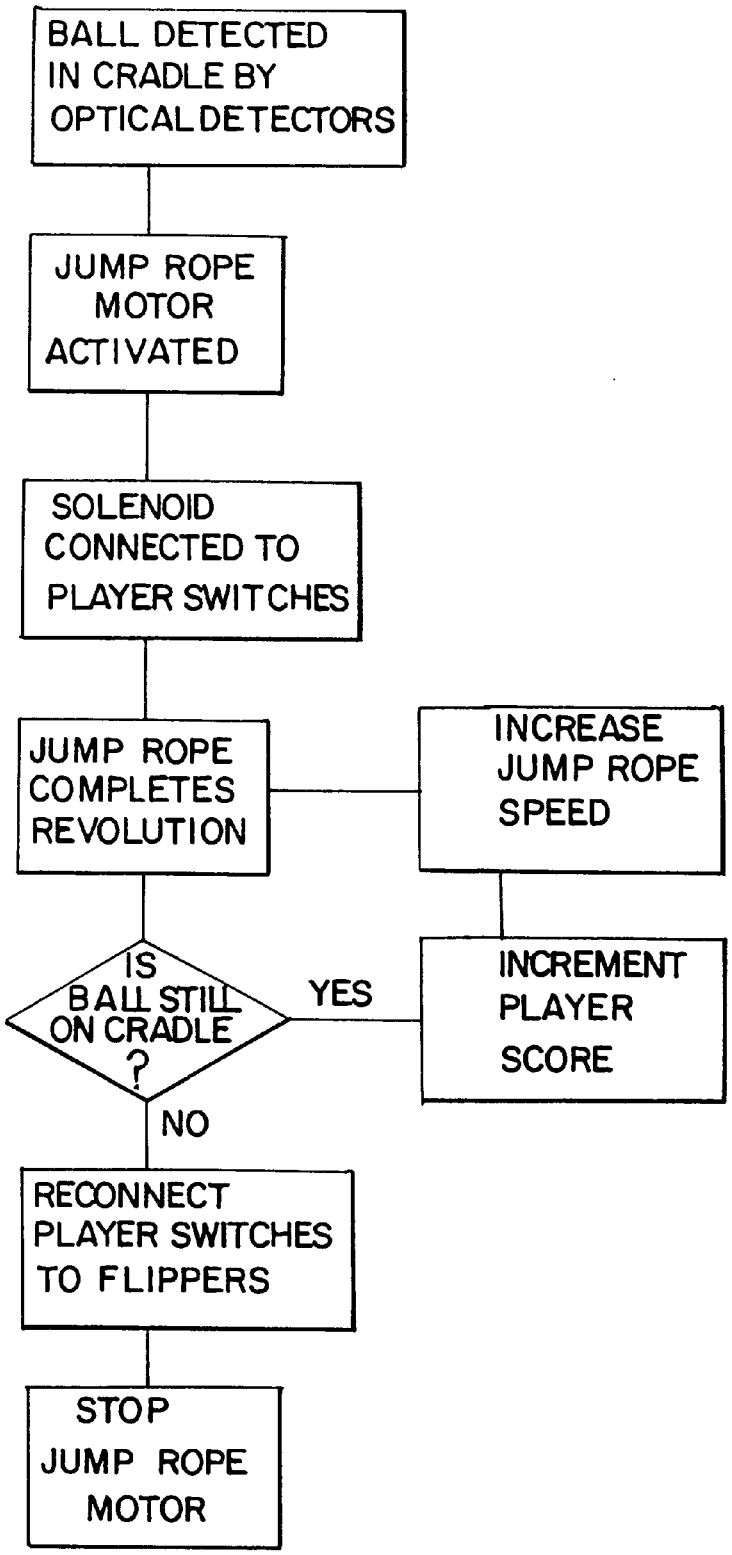
FIG. 4 is a flow diagram of the operations performed by the game microprocessor according to the invention.

As a result, as shown in FIG. 4, microprocessor 110 activates jump rope motor 72 so that jump rope 90 begins to turn. When the jump rope feature is in operation, the player switches 22 are utilized to operate solenoid plunger mechanism 60. Accordingly, microprocessor 110 also "disconnects" player switches 22 (FIG. 1) from flippers 20 and "reconnects" them to solenoid plunger mechanism 60. Alternatively, a separate switch button, indicated at 112 in FIG. 1, may be provided and dedicated to operating solenoid plunger mechanism 60. Immediately after the solenoid mechanism fires, electromagnet 42 is briefly activated. The purpose of this function will be explained below.

Referring to FIG. 2, with jump rope 90 approaching the game ball 54 positioned in cradle 48, the player faces the challenge of activating the player switches so that the ball "jumps" over jump rope 90. More specifically, the player must activate the player switches at the proper time so that the ball is "popped" into the air to permit the jump rope to pass under it. The positions of the game ball 54 and jump rope 90 during such a maneuver are shown in FIG. 3. After the solenoid plunger mechanism 60 fires, microprocessor 110 immediately energizes electromagnet 42 for roughly 0.5–1 second. As a result, electromagnet 42 exerts a centering force upon the game ball 54 while it is in mid-air so that it remains centered over cradle 48. In addition, electromagnet 42 "pulls" the game ball towards central opening 47 so that the ball returns to its original position in the cradle 48.

Switch 76 (FIG. 2) signals microprocessor 110 when the jump rope has completed a revolution. At this time, as shown in FIG. 4, microprocessor 110 checks optical detectors 100 and 102 to determine if the ball has returned to the cradle. If the ball has returned to the cradle, the player has successfully completed a "jump" and his or her score is increased. In addition, the speed ofjump rope rotation may also be increased. The jump rope rotates at higher and higher speeds, the player's score increases and the cycle is repeated until the player fails to successfully complete his jump. When this occurs, the game ball is knocked away from its position over or on cradle 48 by wire form jump rope 90 and onto ramp 32 so that it rolls onto playfield 12. When the jump rope completes its next revolution, optical detectors 100 and 102 signal microprocessor 110 that the game ball has not returned to the cradle. As a result, microprocessor 110 reconfigures the player switches so that they once again control the game flippers 20 (FIG. 1), the jump rope 90 returns to its initial position (as marked by switch 76) and the jump rope motor is shut off.

While the preferred embodiments of the invention have been shown and described, it will be apparent to those skilled in the art that changes and modifications may be made therein without departing from the spirit of the invention, the scope of which is defined by the appended claims.

What is claimed is:

1. A jump rope play feature for a pinball game, where the pinball game is controlled by a computer and has an inclined playfield for supporting a game ball thereon and flippers that are activated by player switches to propel the game ball on said playfield, said jump rope play feature comprising:

a) a cradle including a central opening, said cradle adapted to be positioned relative to said playfield so that it may receive and hold said game ball;

b) a plunger mechanism positioned beneath said cradle and centered on said opening so that when said plunger mechanism is activated, said game ball is propelled generally upwardly above said cradle;

c) a motor; and d) an arcuate wire form, one end of which is connected to said motor so that when said motor is operated, said wire form rotates so that it passes beneath said game ball if said ball has been propelled above said cradle by said plunger mechanism.

2. The jump rope play feature of claim 1 further comprising an electromagnet positioned beneath said cradle and centered on said opening, said electromagnet being activated after said plunger mechanism to exert a centering force on and to pull said game ball back towards said cradle.

3. The jump rope play feature of claim 1 further comprising a detector for detecting when said game ball is positioned within said cradle to initiate operation of said motor.

4. The jump rope play feature of claim 3 wherein said detector halts operation of said motor when said wire form knocks said game ball away from said cradle.

5. The jump rope play feature of claim 1 further comprising a switch for determining when said wire form has completed a revolution whereby said computer may increment a player's game score.

6. The jump rope play feature of claim 1 wherein said plunger mechanism is player controlled.

7. The jump rope play feature of claim 6 wherein said plunger mechanism is player controlled using said player switches.

8. The jump rope play feature of claim 6 wherein said plunger mechanism is player controlled using a switch button that is dedicated to operating solely said plunger mechanism.

9. A jump rope play feature for a pinball game, where the pinball game has an inclined playfield for supporting a game ball thereon and flippers that are activated by player switches to propel the game ball on said playfield, said jump rope play feature comprising:

a) a cradle including a central opening, said cradle adapted to be positioned relative to said playfield so that it may receive and hold said game ball;

b) a plunger mechanism positioned beneath said cradle and centered on said opening so that when said plunger mechanism is activated, said game ball is propelled generally upwardly above said cradle;

c) a motor;

d) an arcuate wire form, one end of which is connected to said motor so that when said motor is operated, said wire form rotates so that it passes beneath said game ball if said ball has been propelled above said cradle by said plunger mechanism;

e) an electromagnet positioned beneath said cradle and centered on said opening;

f) a detector for detecting when said game ball is positioned within said cradle;

g) a switch for determining when said wire form has completed a revolution; and h) a computer in communication with said motor, said detector, said electromagnet and said switch;

whereby said computer initiates operation of said motor when said detector indicates that said game ball is within said cradle, activates said electromagnet briefly after said plunger mechanism has been activated and halts operation of said motor when said switch indicates that said wire form has completed a complete revolution and said detector indicates that said game ball is not within said cradle.

10. The jump rope play feature of clam 9 wherein said computer operates said motor at an increased speed when said switch indicates that said jump rope has completed a revolution and said detector indicates that said game ball is within said cradle.

11. The jump rope play feature of claim 9 wherein said computer increments a player's score when said switch indicates that said jump rope has completed a revolution and said detector indicates that said game ball is within said cradle.

12. The jump rope play feature of claim 9 wherein said computer configures said player switches so that they operate said plunger mechanism when said game ball is within said cradle.

13. A jump rope play feature for a pinball game, where the pinball game is controlled by a computer and has an inclined playfield for supporting a game ball thereon and flippers that are activated by player switches to propel the game ball on said playfield, said jump rope play feature comprising:

a) means for cradling said game ball;

b) means for propelling said game ball above said means for cradling;

c) an arcuate wire form; and d) means for rotating said arcuate wire form so that it passes under said game ball when it is propelled above said means for cradling.

14. The jump rope play feature of claim 13 further comprising means for attracting said game ball to said means for cradling so that when said game ball is propelled by said means for propelling, said game ball is centered above and pulled towards said means for cradling.

15. The jump rope play feature of claim 13 further comprising means for detecting when said game ball is positioned within said means for cradling, said means for detecting activating said means for rotating when said game ball is positioned within said means for cradling.

16. The jump rope play feature of claim 13 further comprising means for determining when said wire form has completed a revolution.

17. The jump rope play feature of claim 13 wherein said means for propelling is player controlled.

18. The jump rope play feature of claim 13 further comprising means for connecting said player switches to said means for propelling when said game ball is within said means for cradling.

* * * * *